US010400961B2

(12) United States Patent
Wang et al.

(10) Patent No.: US 10,400,961 B2
(45) Date of Patent: Sep. 3, 2019

(54) DOUBLE-SIDED LED LIGHTING DEVICE

(71) Applicant: GE Lighting Solutions, LLC, East Cleveland, OH (US)

(72) Inventors: Xin Wang, Shanghai (CN); Brian Morgan Spahnie, East Cleveland, OH (US); Suping Wang, Shanghai (CN); Yan Ni, Shanghai (CN)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 15/485,600

(22) Filed: Apr. 12, 2017

(65) Prior Publication Data

US 2017/0307147 A1 Oct. 26, 2017

(30) Foreign Application Priority Data

Apr. 20, 2016 (CN) ..... 2016 1 0250126

(51) Int. Cl.
*F21K 9/69* (2016.01)
*F21V 29/70* (2015.01)
(Continued)

(52) U.S. Cl.
CPC ..... *F21K 9/69* (2016.08); *F21K 9/275* (2016.08); *F21K 9/66* (2016.08); *F21S 4/28* (2016.01);
(Continued)

(58) Field of Classification Search
CPC ... F21K 9/69; F21K 9/66; F21K 9/275; F21V 29/70; F21V 29/89; F21V 3/02;
(Continued)

(56) References Cited

U.S. PATENT DOCUMENTS 7,712,931 B1 5/2010 Smith
7,926,977 B2 4/2011 Nall et al.
(Continued)

FOREIGN PATENT DOCUMENTS

AT 10993 U2 2/2010
CN 203068259 U 7/2013
(Continued)

OTHER PUBLICATIONS

Extended European Search Report and Opinion issued in connection with corresponding EP Application No. 17165631.7 dated Jul. 17, 2017.
(Continued)

*Primary Examiner* — Karabi Guharay
*Assistant Examiner* — Hana S Featherly
(74) *Attorney, Agent, or Firm* — Buckley, Maschoff & Talwalkar, LLC

(57) ABSTRACT

A lighting device includes an elongated support member, first and second printed circuit boards, at least one first LED, at least one second LED and at least one lens element. The elongated support member includes first and second sides, the first and second PCBs coupled to the first and second sides of the elongated support member, respectively, the at least one first LED mounted on the first PCB and the at least one second LED mounted on the second PCB, each lens element includes at least one lens, the lens element mounted on the PCB at a location such that each lens substantially surrounds a respective one of the LEDs.

12 Claims, 9 Drawing Sheets

(51) Int. Cl.

| | |
|---|---|
| ***F21V 29/89*** | (2015.01) |
| ***F21K 9/66*** | (2016.01) |
| ***F21K 9/275*** | (2016.01) |
| ***F21V 19/00*** | (2006.01) |
| ***F21V 3/02*** | (2006.01) |
| ***F21V 5/04*** | (2006.01) |
| ***F21S 4/28*** | (2016.01) |
| *F21Y 103/10* | (2016.01) |
| *F21Y 115/10* | (2016.01) |
| *F21Y 107/90* | (2016.01) |

(52) U.S. Cl.
CPC ..... *F21V 3/02* (2013.01); *F21V 5/046* (2013.01); *F21V 19/0035* (2013.01); *F21V 19/0045* (2013.01); *F21V 29/70* (2015.01); *F21V 29/89* (2015.01); *F21Y 2103/10* (2016.08); *F21Y 2107/90* (2016.08); *F21Y 2115/10* (2016.08)

(58) Field of Classification Search
CPC .. F21V 5/046; F21V 19/0035; F21V 19/0045; F21S 4/28; F21Y 2107/90; F21Y 2103/10; F21Y 2115/10
USPC ..... 362/218
See application file for complete search history.

(56) References Cited

U.S. PATENT DOCUMENTS

| | | | | |
|---|---|---|---|---|
| 2012/0153865 | A1 | 6/2012 | Rolfes et al. | |
| 2013/0050999 | A1* | 2/2013 | Simon ..... | H05K 3/0061 362/218 |
| 2014/0204570 | A1 | 7/2014 | Burmeister et al. | |

FOREIGN PATENT DOCUMENTS

| | | | |
|---|---|---|---|
| CN | 203099541 | U | 7/2013 |
| CN | 203205453 | U | 9/2013 |
| CN | 204611423 | U | 9/2015 |
| CN | 205026475 | U | 2/2016 |
| DE | 20 2013 101 828 | U1 | 7/2014 |
| WO | 2007/090292 | A1 | 8/2007 |
| WO | 2014/063447 | A1 | 5/2014 |
| WO | 2014/113766 | A1 | 7/2014 |

OTHER PUBLICATIONS

Machine Translation and First Office Action and Search issued in connection with corresponding CN Application No. 201610250126.3 dated Mar. 4, 2019, 15 pages.
Communication pursuant to Article 94(3) EPC in connection with corresponding EP Application No. 17165631.7 dated Apr. 5, 2019, 4 pp.

* cited by examiner

DOUBLE-SIDED LED LIGHTING DEVICE

BACKGROUND

The invention relates generally to lighting devices and related technologies. More particularly, this invention relates to a lighting device with a double sided light emitting diode (LED).

Conventional lighting devices use fluorescent tubes because fluorescent tubes emit light in a 360 degrees pattern from a central axis, and therefore it can emit light in all directions. For example, a traditional light box has multiple fluorescent tubes mounted at intervals in the box, and the fluorescent tubes illuminate every panel of the box.

Recently, more businesses and home owners are turning to LED tubes as their first choice for lighting, because LED tubes provide a variety of advantages over traditional fluorescent tubes, including but not limited to a lower long term cost, longer life expectancy, lower noise, warmer color, smaller environmental impact, and lower energy consumption.

As the viewing angle of an LED is less than 180 degrees from a central axis, double sided lighting LED tubes are used in the light box application. In some cases, the optic performance of LED light boxes may be not good enough. For example, there may be highly bright strip spot at the panel of a shallow LED light box. Furthermore, as the LEDs and electrical components generate heat during working and the LED tube typically is a completely enclosing area, it is difficult for the LED tube to expel the heat outside, which may reduce the lifetime of the LEDs and electrical components.

BRIEF DESCRIPTION

In one aspect, a lighting device includes an elongated support member, first and second printed circuit boards, at least one first LED, at least one second LED and at least one lens element. The elongated support member includes first and second sides; the first and second PCBs coupled to the first and second sides of the elongated support member, respectively; the at least one first LED mounted on the first PCB and the at least one second LED mounted on the second PCB; each lens element includes at least one lens, the lens element mounted on the PCB at a location such that each lens substantially surrounds a respective one of the LEDs.

In another aspect, a lighting device includes an elongated support member, first and second printed circuit boards, at least one first LED, at least one second LED, at least one lens element and a tubular cover. The elongated support member includes first and second sides; the first and second PCBs coupled to the first and second sides of the elongated support member, respectively; the at least one first LED mounted on the first PCB and the at least one second LED mounted on the second PCB; each lens element includes at least one lens, the lens element mounted on the PCB at a location such that each lens substantially surrounds a respective one of the LEDs; the tubular cover includes a translucent section for allowing light from the LEDs to escape, wherein, the tubular cover includes at least one recess, the elongated support member comprises a longitudinal end portion configured to connect to the at least one recess of the tubular cover.

DRAWINGS

These and other features and aspects of the present disclosure will become better understood when the following detailed description is read with reference to the accompanying drawings in which like characters represent like parts throughout the drawings, wherein.

DETAILED DESCRIPTION

Unless defined otherwise, technical and scientific terms used herein have the same meaning as is commonly understood by one of ordinary skill in the art to which this disclosure belongs. The terms "first", "second", and the like, as used herein do not denote any order, quantity, or importance, but rather are employed to distinguish one element from another. Also, the terms "a" and "an" do not denote a limitation of quantity, but rather denote the presence of at least one of the referenced items. The use of "including," "comprising" or "having" and variations thereof herein are meant to encompass the items listed thereafter and equivalents thereof as well as additional items. The terms "connected" and "coupled" are not restricted to physical or mechanical connections or couplings, and can include electrical connections or couplings, whether direct or indirect.

Figure 1:
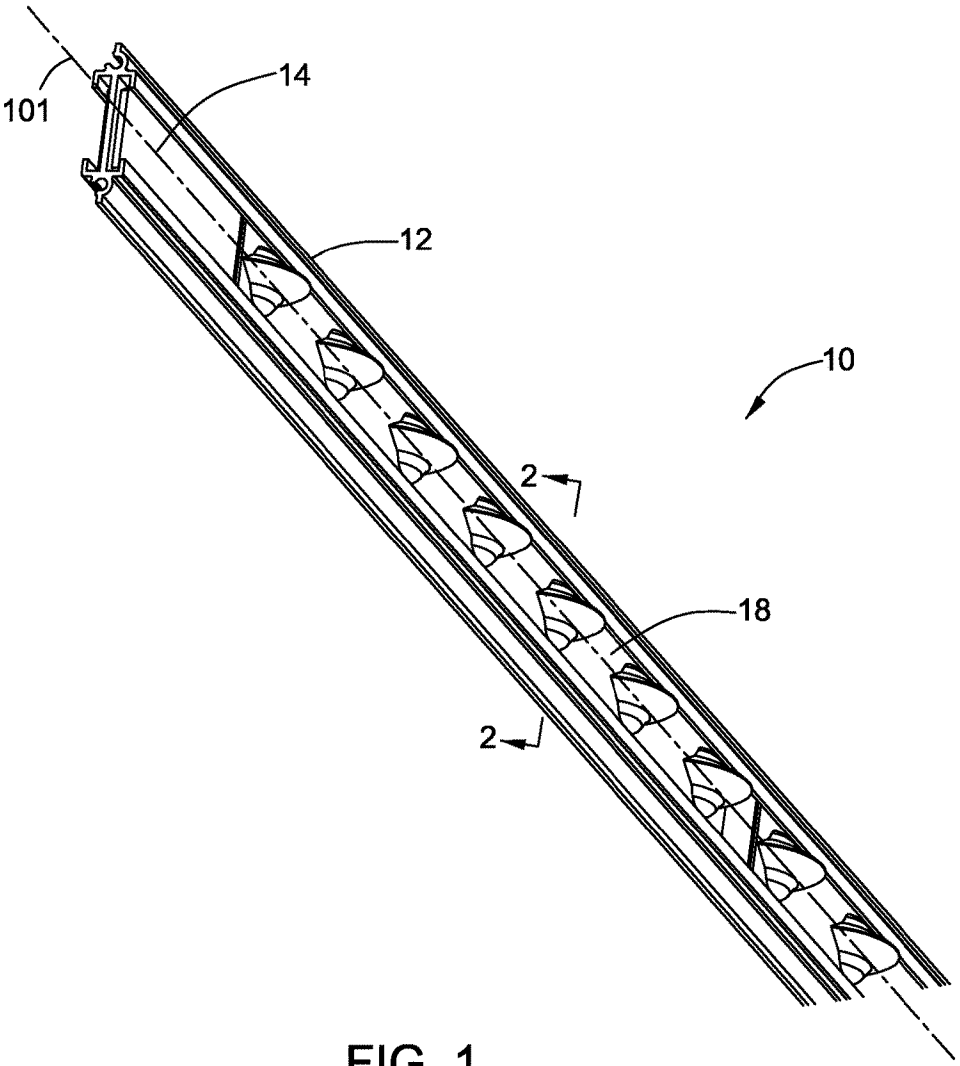
FIG. 1 is a partial perspective view of a lighting device in accordance with an embodiment of this invention.
Figure 2:
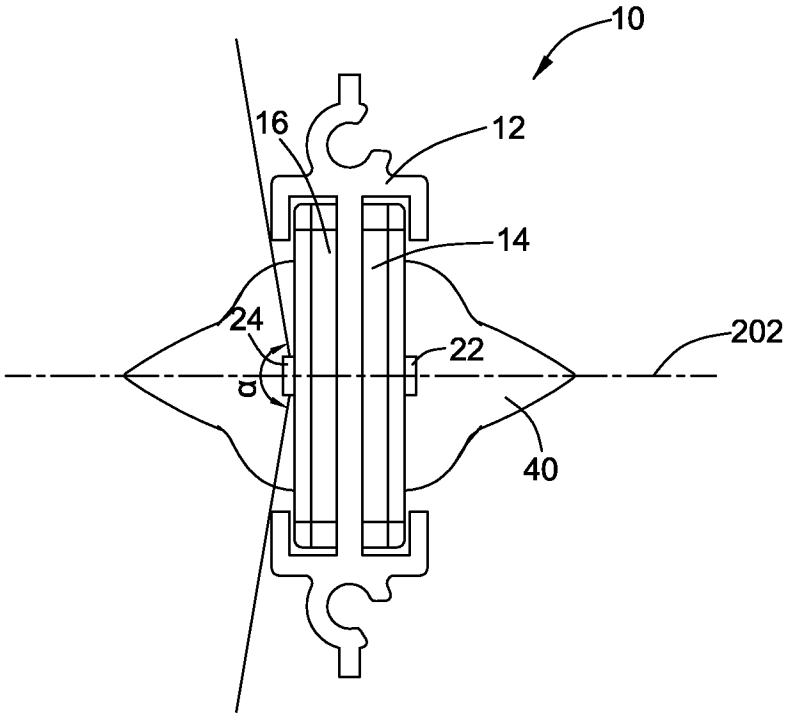
FIG. 2 is a cross sectional view of the lighting device of FIG. 1, taken along the line 2-2 in FIG. 1.
Figure 5B:
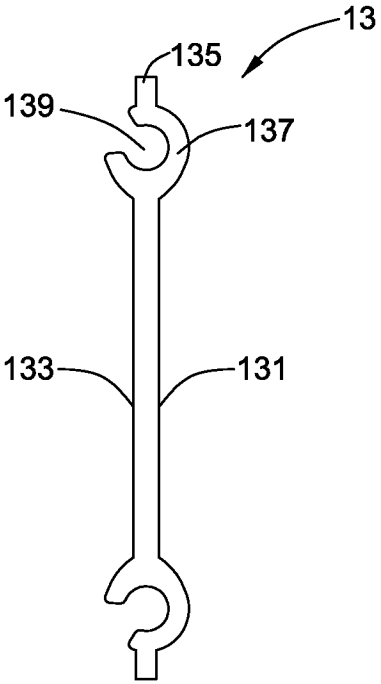
FIG. 5B shows another embodiment of the elongated support member of the lighting device of FIG. 1.
Figure 5A:
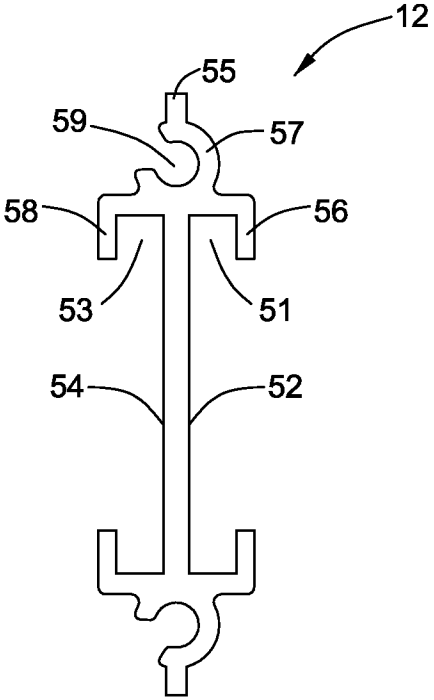
FIG. 5A is a side view of an elongated support member of the lighting device of FIG. 1.

FIG. 1 is a partial perspective view of a lighting device 10 in accordance with an embodiment of this invention. As the lighting device 10 has an elongated structure, only a longitudinal section adjacent to one longitudinal end of the lighting device 10 is visible in FIG. 1 and the other longitudinal section adjacent to the other longitudinal end of the lighting device 10 is omitted. FIG. 2 is a cross sectional view of the lighting device 10 of FIG. 1 taken along line 2-2 in FIG. 1. As shown in FIGS. 1 and 2, the light device 10 includes an elongated support member 12, a first printed circuit board (PCB) 14, a second PCB 16 (at an opposite side of the first PCB 14 and is not shown in FIG. 1), at least one first light emitting diode (LED) 22, at least one second LED 24, and at least one lens element 18. With reference to FIG. 5A, the elongated support member 12 includes a first side 52 and a second side 54. In one embodiment, the first and second sides 52, 54 are opposite to each other. The first PCB 14 is coupled to the first side 52 of the elongated support member 12, and the second PCB 16 is coupled to the second side 54 of the elongated support member 12.

Figure 3A:
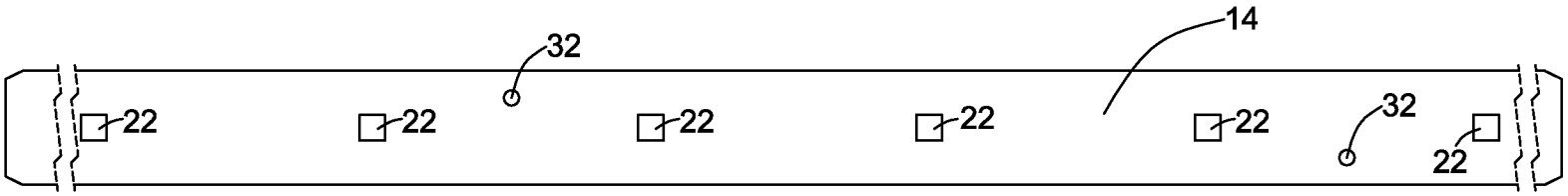
FIG. 3A is a partial top view of a portion of the lighting device of FIG. 1.
Figure 3B:
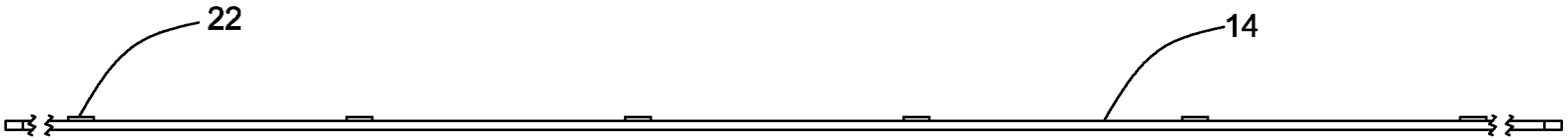
FIG. 3B is a partial front view of the portion of FIG. 3A.

FIGS. 3A and 3B are a partial top view and front view of a portion of the lighting device 10 of FIG. 1, showing the first PCB 14 and the at least one first LED 22 mounted on the first PCB 14. In one embodiment, a plurality of first LEDs 22 are located at intervals on the first PCB 14 along a direction parallel to a longitudinal axis 101 (shown in FIG. 1) of the lighting device 10. The number of the first LED 22 depends on a length of the light device 10, a viewing angel of the light device 10 and different light application area. In some embodiments, the number of the first LEDs 22 is 42, and the distances (center-to-center) between adjacent LEDs 22 are substantially the same. In some embodiments, the distances between adjacent LEDs 22 are different. With reference to FIG. 1, the second PCB 16 is symmetrical with the first PCB 14 respect to the elongated support member 12. In some embodiments, each of the second LED 24 mounted on the second PCB 16 is symmetrical with a corresponding one of the first LED 22 respect to the elongated support member 12. In some embodiments, not all the second LEDs 24 are symmetrical with the first LEDs 22 respectively respect to the elongated support member 12.

Figure 4A:
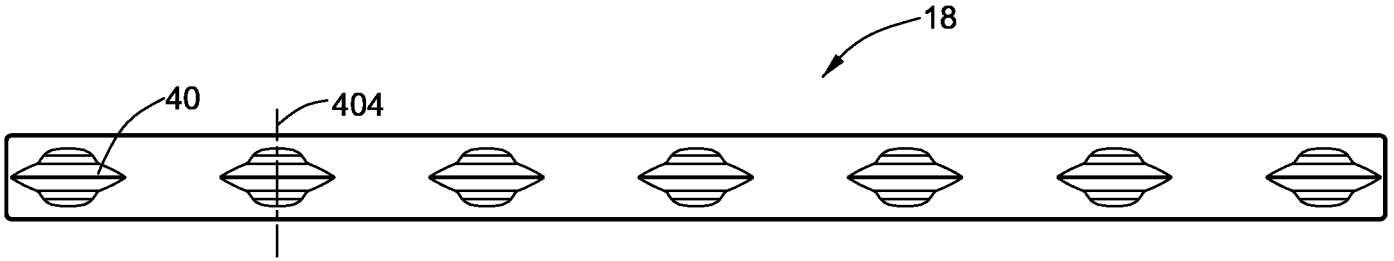
FIG. 4A is a top view of one lens element of the lighting device of FIG. 1.

As shown in FIG. 3A, the first PCB 14 has at least one hole 32, the hole 32 is configured to accommodate the at least one lens element 18 (shown in FIG. 4A). In one embodiment, the at least one hole 32 is arranged along the longitudinal axis 101 (shown in FIG. 1) of the lighting device 10. In one embodiment, there are two holes 32 and one is defined on one side of the longitudinal axis 101 (shown in FIG. 1) of the lighting device 10, and the other is defined on the other side of the longitudinal axis 101. In one embodiment, there may be more than two holes 32 alternately positioned on the two sides of the longitudinal axis 101 of the lighting device 10. The second PCB 16 may be similar with the first PCB 14.

Figure 4B:
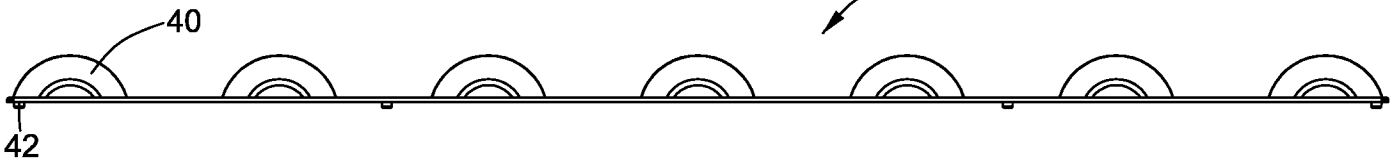
FIG. 4B is a front view of the lens element of FIG. 4A.
Figure 4C:
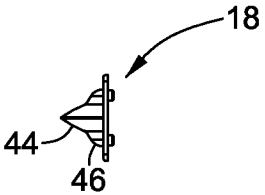
FIG. 4C is a side view of the lens element of FIG. 4A.

FIGS. 4A, 4B and 4C show a top view, front view and side view of one lens element 18 of the lighting device 10 of FIG. 1, respectively. Each lens element 18 includes at least one lens 40. In one embodiment each lens element 18 includes seven lenses 40. The at least one lens element 18 is mounted on the first or second PCBs 14, 16 at a location such that each lens 40 substantially surrounds a respective one of the first and second LEDs 22, 24. In one embodiment, each lens element 18 has at least one pin 42 which can be received in the at least one hole 32 in order to mount the lens element 18 to the first PCB 14 or the second PCB 16. In other embodiments, the at least one lens element 18 may be mounted on the first PCB 14 or the second PCB 16 via elements other than pins, for example, screws, rivets or glue.

With reference to FIGS. 2 and 4C, taking the at least one first LED 22 as an example, each first LED 22 has a main axis of light emission 202 and is substantially surrounded by a respective lens 40 which has a same main axis with the light emission 202. The lens 40 may have any geometry which can bring the LED 22 surrounded by the lens 40 a viewing angle no less than 140 degrees in a plane which is perpendicular to the longitudinal axis 101 and through the center of the lens 40. In one embodiment, the lens 40 is a dome which includes a spherical outer surface. As for the dome lens 40, the viewing angle in each of planes through a center of the dome may be substantially the same and greater than about 150 degrees. In one embodiment, the geometry of the lens 40 is defined by revolving the cross-sectional profile 44 and 46 around an axis of revolution 404 of FIG. 4A, wherein the axis of revolution 404 is perpendicular to the respective main axis of light emission 202 of the respective first LED 22 surrounded by each lens 40. Referring to FIG. 2, the lighting device 10 has an increased viewing angle a in compare with a conventional LED, for example, larger than 170 degrees in a plane perpendicular to the longitudinal axis 101 and through the center of the lens 40.

In one embodiment, the lens element 18 is formed by an injection molding process. In one embodiment, the lens element 18 is formed by a transparent or translucent plastic, such as polycarbonate or acrylic.

FIG. 5A is a side view of the elongated support member 12 of the lighting device 10 of FIG. 1. The elongated support member 12 includes the first side 52, the second side 54, two longitudinal end portions 55, first hooks 56, second hooks 58 and at least one retainer 57. The first hooks 56 define a first slot 51, and the second hooks 58 define a second slot 53. The at least one retainer 57 defines at least one slot 59. With reference to FIG. 1, the first PCB 14 is accommodated in the first slot 51 and the second PCB 16 is accommodated in the second slot 53. In one embodiment, there are two first hooks 56 and two second hooks 58 symmetrically positioned two sides of the elongated support member 12, and the first and second hooks 56, 58 have an elongated structure as the support member 12. The structure of the hooks is not limited herein. In one embodiment, the at least one lens element 18 which mounted on the first PCB 14 is accommodated in the first slot 51, and the at least one lens element 18 which mounted on the second PCB 16 is accommodated in the second slot 53. In one embodiment, taking the first PCB 14 as an example, the assemble of the first PCB 14 and lens element 18 can be inserted and fixed into the first slot 51, which is easily installed during retrofit process.

The elongated support member of the lighting device 10 may have different configurations. For example, FIG. 5B shows another elongated support member 13 which can be used in the lighting device 10 of FIG. 1 and replace the elongated support member 12. The elongated support member 13 includes the first side 131, the second side 133, two longitudinal end portions 135 and at least one retainer 137. The at least one retainer 137 defines at least one slot 139. With reference to FIG. 1, in one embodiment, the first PCB 14 together with the lens element 18 may be mounted on the first side 131 of the elongated support member 13 via screws, rivets or glue, and the second PCB 16 together with the lens element 40 may be mounted on the second side 133 of the elongated support member 13 via screws, rivets or glue.

The elongated support member 12 or 13 is configured to support the lighting device 10 (including the first PCB 14 and the second PCB 16) and facilitate the heat dissipation of the lighting device 10. So the elongated support member 12 or 13 is made of a material having a heat transfer coefficient of at least 50 W/mK, more preferably of at least 200 W/mK. In one embodiment, the elongated support member 12 or 13 is made of a light metal material comprising aluminum, magnesium or a combination thereof.

Figure 6:
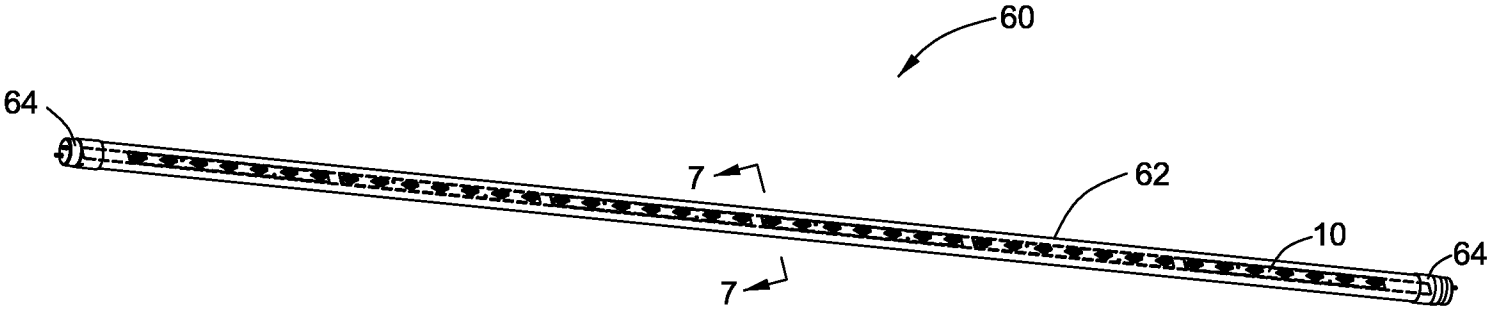
FIG. 6 is a perspective view of a LED tube using the lighting device of FIG. 1, in which the lighting device is covered by a tubular cover.

FIG. 6 is a perspective view of a LED tube 60 using the lighting device 10 of FIG. 1, in which the lighting device 10 is covered by a tubular cover 62. The LED tube 60 includes the tubular cover 62 for covering the lighting device 10, two end caps 64 and the lighting device 10. The dimensions of the lighting device 10 and the configuration of the first and second LEDs 22, 24 are deciding the geometry of the tubular cover 62. The tubular cover 62 is configured to protect the lighting device 10 from water, dust or other pollutions. The tubular cover 62 having a translucent section for allowing light from the first and second LEDs 22, 24 to escape, and the end caps 64 is connected with the tubular cover 62 at each end of the tubular cover 62.

Figure 7:
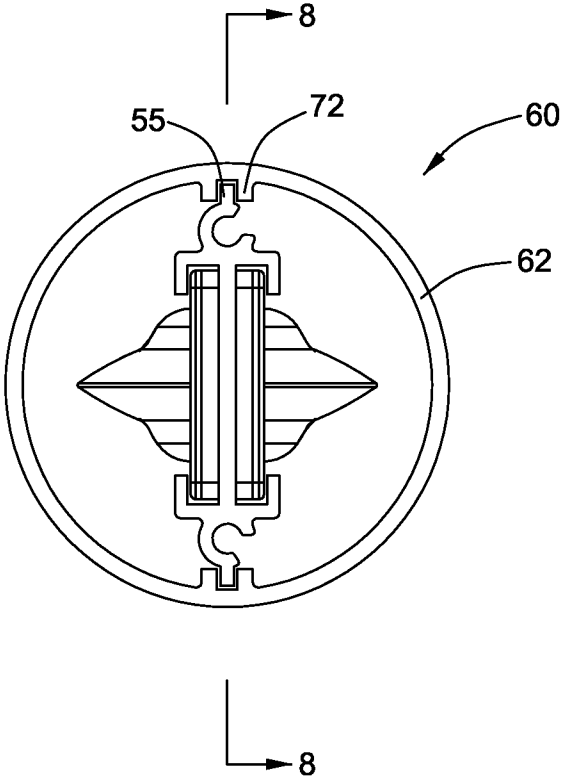
FIG. 7 is a cross sectional view of the LED tube of FIG. 6, taken along the line 7-7 in FIG. 6.

FIG. 7 is a cross sectional view of the LED tube 60 of FIG. 6, taken along the line 7-7 in FIG. 6. The tubular cover 62 is coupled to the elongated support member 12 of the lighting device 10. In some embodiments, one of the tubular cover and the elongated support member includes a recess, the other one of the tubular cover and the elongated support member includes a portion received in the recess. In one specific embodiment, the tubular cover 62 defines two recesses 72 for receiving the two longitudinal end portions 55, respectively. The shape and size of each recess 72 are designed to match the corresponding longitudinal end portion 55.

Figure 8:
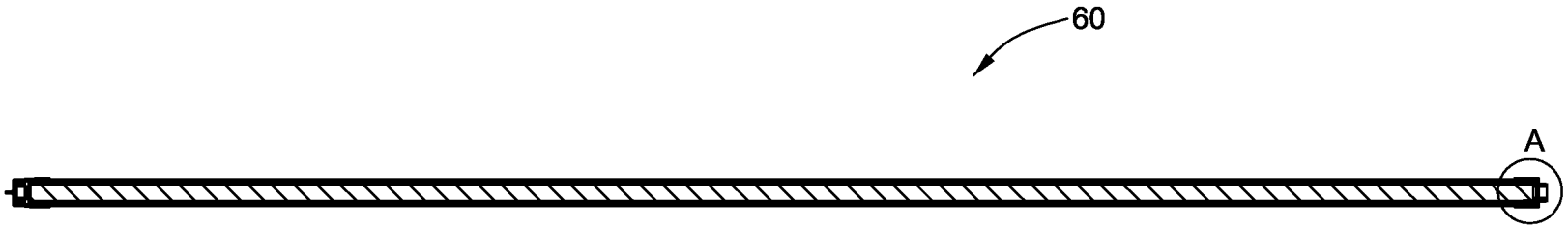
FIG. 8 is a cross sectional view of the LED tube of FIG. 7, taken along the line 8-8 in FIG. 7.
Figure 9:
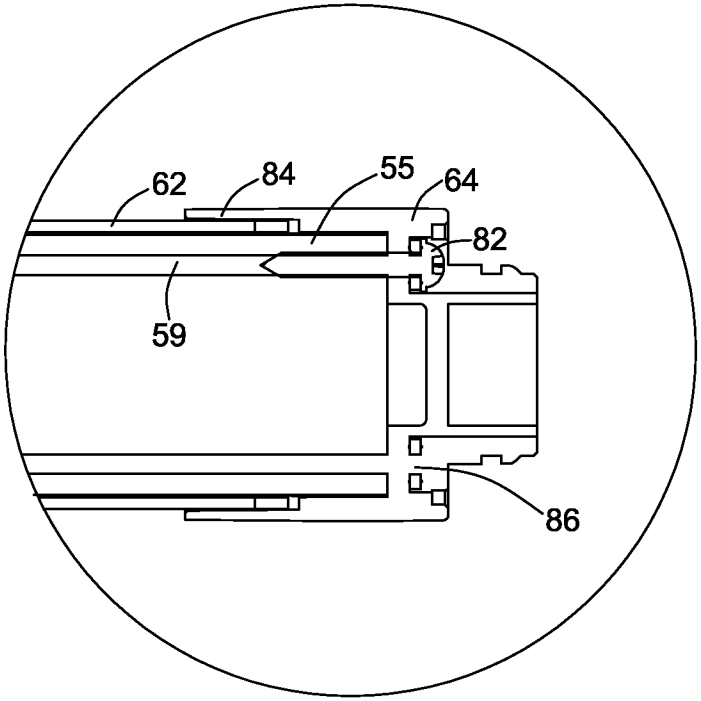
FIG. 9 is a partial enlarged view of the portion A encircled in FIG. 8.

FIG. 8 is a cross sectional view of the LED tube 60 of FIG. 7, taken along the line 8-8 in FIG. 7, and FIG. 9 is a partial enlarged view of the portion A encircled in FIG. 8. One end 84 of the end cap 64 is attached to a longest dimension of the tubular cover 62. The end cap 64 includes at least one opening 86, at least fastener 82 is configured to assemble the end cap 64 at the end of the tubular cover 62 through the at least one opening 86 and the slot 59 of the elongated support member 12. In one embodiment, two fasteners 82 are used to fasten the end cap 64 to the tubular cover 62. And the fastener 82 is a screw in some embodiments.

The LED tubes 60 as described above can be used in a light box or other lighting apparatus. In one embodiment, a plurality of the LED tubes 60 as described above, which may have a length of about one and a half meters, are parallel arranged in a light box. The LED tubes 60 may be either parallel or vertical relative to the ground. The lighting device 10, the LED tubes 60, or the light box as described herein above, bring at least advantages as follows.

Firstly, the elongated support member 12 provides support to the commercial PCB and tubular cover 62 which may be easy to bend, and thus make a LED tube of a larger length be possible Secondly, the elongated support member 12 between the first PCB 14 and second PCB 16 may have an efficient heat transfer capability and therefore can improve the heat dissipation for the first and second LEDs 22, 24 and other electrical components which may generate a lot of heat during working. With the improved heat dissipation, the lighting device as described above is particular applicable for shallow light boxes, which have a small space for heat dissipation.

Thirdly, the double sides LED lighting device can be used in the light box to illuminate both the front panel and the rear panel of the light box. The optic performance of the conventional LED which has a view angle of 120 degrees may be not good enough, especially for the shallow light box. For example, a lighting device 10 with a lens 40 described herein may bring a viewing angle not less than 140 degrees at a specific plane, more preferably larger than 170 degrees. With a suitable arrangement in the light box, the LED tubes 60 may provide a more efficient and uniform lighting distribution, and the highly strip spot at the both panels of the light box can be basically eliminated.

While embodiments of the invention have been described herein, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed for carrying out this invention, but that the invention will include all embodiments falling within the scope of the appended claims.

Furthermore, the skilled artisan will recognize the interchangeability of various features from different embodiments. The various features described, as well as other known equivalents for each feature, can be mixed and matched by one of ordinary skill in this art to construct additional systems and techniques in accordance with principles of this disclosure.

The invention claimed is:

1. A lighting device, comprising:

an elongated support member comprising first and second sides;

first and second printed circuit boards (PCBs) coupled to the first and second sides of the elongated support member, respectively, wherein the first and second sides of the elongated support member are opposite to each other;

at least one first light emitting diode (LED) mounted on the first PCB;

at least one second LED mounted on the second PCB; and at least one lens element, the at least one lens element comprising more than one lens, the lens element mounted on the first or second PCB at a location such that each lens of the lens element substantially surrounds a respective one of the LEDs.

2. The lighting device according to claim 1, wherein the elongated support member further comprises a longitudinal end portion configured to connect with a tubular cover having a translucent section for allowing light from the LEDs to escape.

3. The lighting device according to claim 1, wherein the elongated support member is made of a material having a heat transfer coefficient of at least 50 W/mK.

4. The lighting device according to claim 1, wherein the elongated support member is made of a light metal material comprising aluminum, magnesium or a combination thereof.

5. The lighting device according to claim 1, wherein the elongated support member defines a first slot and a second slot, and the first PCB is accommodated in the first slot and the second PCB is accommodated in the second slot.

6. The lighting device according to claim 5, wherein the at least one lens element is accommodated in the first or second slot.

7. A lighting device, comprising:

an elongated support member comprising first and second sides;

first and second printed circuit boards (PCBs) coupled to the first and second sides of the elongated support member, respectively;

at least one first light emitting diode (LED) mounted on the first PCB;

at least one second LED mounted on the second PCB; and at least one lens element, each lens element comprising at least one lens, the lens element mounted on the PCB at a location such that each lens substantially surrounds a respective one of the LEDs, wherein each of the LEDs have a respective main axis of light emission, each of the lens have a geometry defined by at least partial revolution of a cross-sectional profile around an axis of revolution, and the axis of revolution is perpendicular to the respective main axis of light emission of the respective LED surrounded by said each lens.

8. A lighting device, comprising:

an elongated support member comprising first and second sides;

first and second printed circuit boards (PCBs) coupled to the first and second sides of the elongated support member, respectively;

at least one first light emitting diode (LED) mounted on the first PCB;

at least one second LED mounted on the second PCB; and at least one lens element, each lens element comprising at least one lens, the lens element mounted on the PCB at a location such that each lens substantially surrounds a respective one of the LEDs, wherein the elongated support member has a longitudinal axis and each of the LEDs with the lens has a viewing angle no less than 140 degrees in a plane perpendicular to the longitudinal axis and through the center of the lens.

9. A lighting device, comprising:

an elongated support member comprising first and second sides, wherein the first and second sides of the elongated support member are opposite to each other;

first and second printed circuit boards (PCBs) coupled to the first and second sides of the elongated support member, respectively;

at least one first light emitting diode (LED) mounted on the first PCB;

at least one second LED mounted on the second PCB;

at least one lens element, the at least one lens element comprising more than one lens, the lens element mounted on the PCB at a location such that each lens of the lens element substantially surrounds a respective one of the LEDs; and a tubular cover coupled to the elongated support member and having a translucent section for allowing light from the LEDs to escape.

10. The lighting device according to claim 9, wherein one of the tubular cover and the elongated support member comprises a recess, the other one of the tubular cover and the elongated support member comprises a portion received in the recess.

11. The lighting device according to claim 9, wherein each of the LEDs have a respective main axis of light emission, each of the lens have a geometry defined by at least partial revolution of a cross-sectional profile around an axis of revolution, and the axis of revolution is perpendicular to the respective main axis of light emission of the respective LED surrounded by said each lens.

12. The lighting device according to claim 9, wherein the elongated support member has a longitudinal axis and each of the LEDs with the lens has a viewing angle no less than 140 degrees in a plane perpendicular to the longitudinal axis and through the center of the lens.

* * * * *